United States Patent [19]

Krambrock

[11] Patent Number: 4,818,117

[45] Date of Patent: Apr. 4, 1989

[54] APPARATUS FOR MIXING BULK MATERIALS IN DUST, POWDER OR COARSE GRAINED FORM

[75] Inventor: Wolfgang Krambrock, Vogt, Fed. Rep. of Germany

[73] Assignee: AVT Anlagen-und Verfahrenstechnik GmbH, Vogt, Fed. Rep. of Germany

[21] Appl. No.: 22,172

[22] Filed: Mar. 5, 1987

[30] Foreign Application Priority Data

Mar. 7, 1986 [DE] Fed. Rep. of Germany ..... 3607485

[51] Int. Cl.[4] ..... B01F 13/02

[52] U.S. Cl. ..... 366/341; 366/101; 366/137

[58] Field of Search ..... 366/341, 134, 101, 106, 366/9, 136, 137, 102, 1, 336

[56] References Cited

U.S. PATENT DOCUMENTS

| | | | |
|---|---|---|---|
| 4,068,828 | 1/1978 | Goins . | |
| 4,285,602 | 8/1981 | Hagerty | 366/341 |
| 4,518,260 | 5/1985 | Goins | 366/341 |
| 4,553,849 | 11/1985 | Goins | 366/134 |

FOREIGN PATENT DOCUMENTS

| | | |
|---|---|---|
| 0019446 | 6/1983 | European Pat. Off. . |
| 1217756 | 5/1966 | Fed. Rep. of Germany . |
| 1507885 | 9/1971 | Fed. Rep. of Germany . |
| 2517482 | 10/1976 | Fed. Rep. of Germany . |
| 8124137 | 8/1982 | Fed. Rep. of Germany . |
| 3512538 | 6/1986 | Fed. Rep. of Germany . |
| 1566029 | 3/1969 | France . |
| 1127452 | 9/1968 | United Kingdom . |

OTHER PUBLICATIONS

Mixing and Homogenizing of Granular Bulk Material in a Pneumatic Mixer Unit, W. Krambrock, 1976.

Methods of Mixing Bulk Materials, W. Krambrock, 1981.

*Primary Examiner*—Robert W. Jenkins

*Attorney, Agent, or Firm*—Spencer & Frank

[57] ABSTRACT

A device for blending dust, powder or coarse particle bulk materials, having a first upper blending device with a cylindrical blending container and a connecting discharge funnel which tapers conically towards a second lower blending device. The second lower blending device having a cylindrical container and a connecting discharge hopper which tapers conically towards the bottom to form an upper and lower mass flow silo. There is a blending pipe installed in the upper blending device which extends approximately to the lower end of the upper discharge funnel. The blending pipe contains inlet openings throughout its whole length for bulk material wherein the concentrically installed blending pipe is vertically subdivided into gravity pipes arranged side by side. Each pipe contains several inlet openings arranged above one another. The blending pipe is constructed cylindrically in the lower end region with the bulk material being transported back via a conveying pipe.

15 Claims, 3 Drawing Sheets

APPARATUS FOR MIXING BULK MATERIALS IN DUST, POWDER OR COARSE GRAINED FORM

BACKGROUND OF THE INVENTION

The invention concerns a device for blending dust, powder and coarse particle bulk materials.

The various types and function means of blending devices are described in the DE-A1No. 35 12 538. The content of this publication is hereby referred to expressly.

During the blending process of bulk materials a so-called "funnel flow" or "mass flow" sets in. Mass flow occurs when the total bulk material during discharge starts to move like a fluid, i.e. the total hopper cross-section falls regularly. In the case of funnel flow the material only flows in a "channel" which extends vertically above the outlet and also has approximately the same diameter. At the upper end of the channel a crater shaped depression forms, on the surface of which the material slides radially towards the outlet. Outside this flow crater and outside the flow channel a so-called "dead zone" is formed during the discharge process of a funnel flow hopper, in which no particle movement takes place. A blending effect as in the case of mass flow does not set in. Funnel flow always sets in when the slope angle of the hopper above the material drain outlet is not steep enough. The selection and positioning of the discharge hopper therefore plays a critical role in producing the desired mass flow according to the material characteristics. Various measures for obtaining a best possible blending effect are described in the DE-A1No. 35 12 538.

A further device has become known from the DE-ASNo. 1 507 885 with which a constant blend of the material is apparently achieved without the necessity of returning the material to the silo via a return pipe. This is apparently achieved by providing each gravity pipe with several inlet openings at different heights, whereby each gravity pipe is kept full up to its upper inlet opening underneath the material level in the silo. In the case of this known device the material flows through the gravity pipe at a lower velocity than that of free gravitational velocity, which results in the fact that only the upper inlet openings in the gravity pipe situated in a material layer of the silo are effective, while material is not able to enter the inlet openings below, as the gravity pipe is full in this area. The distribution of the inlet openings in the gravity pipe is formed in such a way that geometrically similar sections of the material in the silo are connected with an opening, so that the material is drained regularly through the openings and a constant blend of the material levels in the silo is achieved, independant of the blended material level of the material. If the blended material level falls gradually, the geometrically similar sections or volumes of the material to be blended is reduced proportionally. The content of this publication DE-AS-1 507 885 is referred to expressly.

SUMMARY OF THE INVENTION

The invention is based on the task of blending bulk material layers with different characteristics in a gravity blender during the emptying process of the blender, whereby dead zones without material movement are avoided, i.e. mass flow is produced. The blender construction with blending devices and blending pipe should be especially optimised in such a way so that a best possible blending result is achieved. A further task is the precise determination of the number and the position of the inlet openings in the gravity pipe as well as the linkage with bulk material circulation in the blender hopper.

This task is solved by a device of the present invention 1.

The measures stated in the claims are advantageous further developments and improvements of the invention.

Due to the characteristic combination according to the invention a best possible blend of the bulk material sets in due to the fact that mass flow in particular sets in in the hopper, i.e. the outer zones of the hopper also fall constantly. The mass flow is effected particularly by the respective angle selection of the discharge hopper, which the specialist selects according to the type of material. The slope angle of the discharge hopper is for example calculated for plastic pellets and with an aluminium hopper in the size of $\alpha \approx 20°$ to 35° from the vertical. The exact angle determination results from literature values or laboratory ratings in connection with the material to be blended.

Due to the combination of the characteristics according to the invention, in particular to the connection in series of two blending devices with cylindrical blending hoppers and discharge funnels in connection with an adapted blending pipe constructed in accordance with the invention, all layers of the silo are blended. It is hereby critical that the flow-through cross-section of the blending pipe is in an adapted cross-section relation to the ring gap of the outlet funnel situated around it, according to the material to be blended. Due to variation of these cross-sections, therefore, material from various levels of the silo are made to flow in variable proportions, whereby the blending effect is produced.

According to the further development of the invention the outlet hopper of the upper blending device protrudes into the blending hopper of the lower blending device, in such a way that the cross-section of the outlet opening of the hopper is in alignment with the cross-section of the blending pipe. In order to ensure unimpeded material transport from the hopper region the hopper has openings or apertures in this area which allow unimpeded vertical material flow.

The individual gravity pipes in the blending pipe are formed by build-in dividing walls or by pipes arranged side by side whereby a honeycomb total cross-section with hexagonal individual pipes is preferably used. The inlet openings of the individual pipes are always directed towards the surrounding hopper.

In order to determine the exact position and the number of the inlet openings in the gravity pipes, a graphical process is provided for exact determination of each individual inlet opening. In this way each required silo height and therefore each position of gravity pipes with inlet openings arranged above one another may be provided in such a way that exactly the same amount of bulk material is extracted in geometrically equal height sections from each main section with each blender filling level in one main level. If the blended material level is between two main sections, at least equal amounts are extracted from geometrically similar height sections.

The formation of sub-levels is provided to which determine the exact height position for the inlet openings. An additional pipe with staggered overlapping inlet openings is provided, so that material may continually be extracted from the respective surface, which improves the blending effect to an even greater extent.

BRIEF DESCRIPTION OF THE DRAWINGS

Further characteristics and advantages relevant to the invention result from the following application examples explained in detail according to the diagram. These are;.

DETAILED DESCRIPTION

Figure 1:
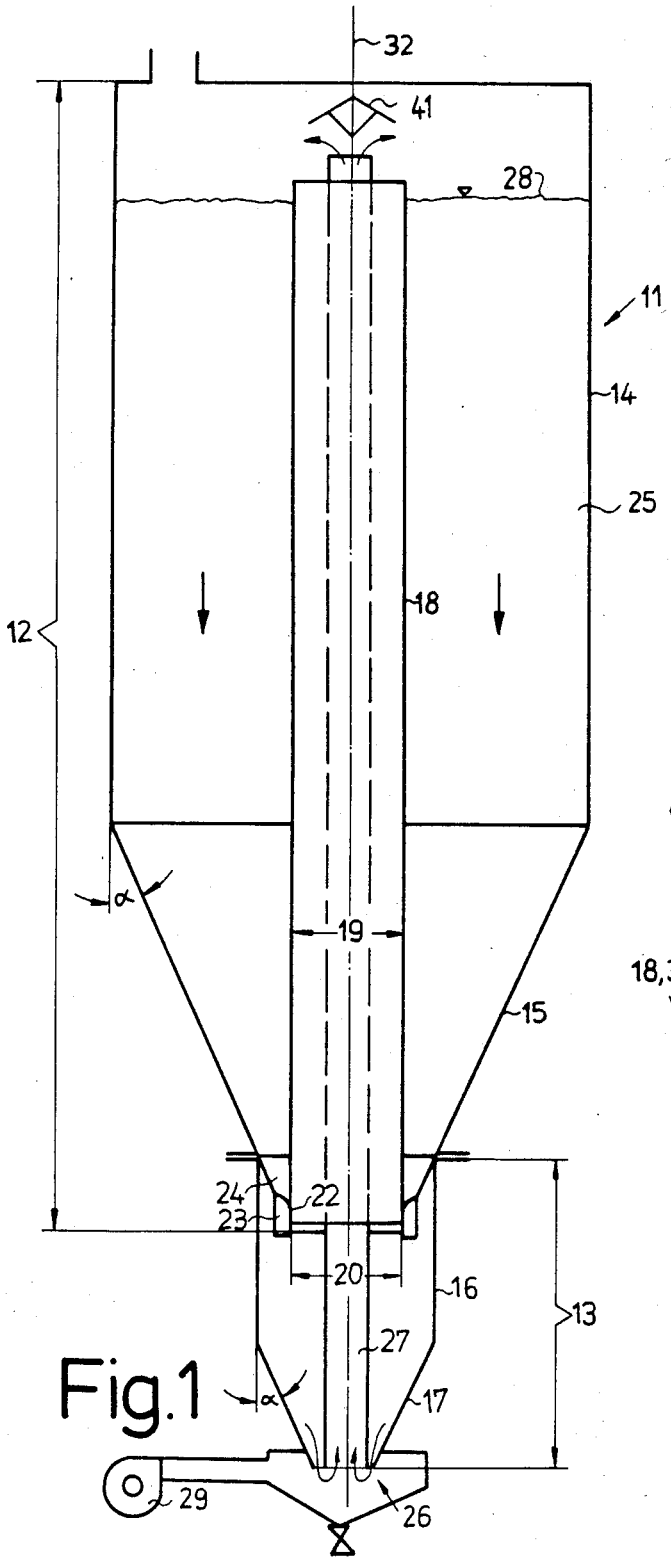
FIG. 1 An application example according to the invention depicted as a diagram.

The device depicted in FIG. 1 (11) consists of one first upper blending device (12) and a second lower blending device (13) which are connected in series. The upper blending device (12) consists of a cylindrical blending hopper (14), which has a first discharge funnel at the lower end (15). The lower blending device (13) is connected after this discharge funnel (15), which also consists of a cylindrical blending hopper (16) with an connecting discharge funnel (17). The upper discharge funnel (15) protrudes into the upper third of the cylindrical blending hopper (16).

Figure 2:
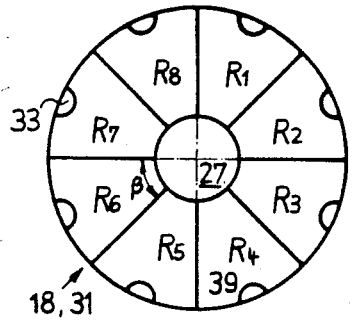
FIG. 2 An enlarged diagram of the blending pipe in the blending hopper with eight individual pipes as well as central pipe.
Figure 3:
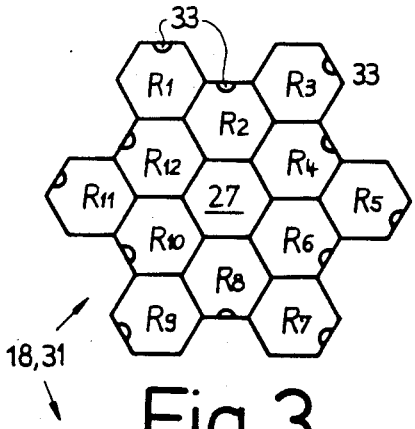
FIGS. 3 and 4 Two alternative construction forms of the blending pipe.
Figure 4:
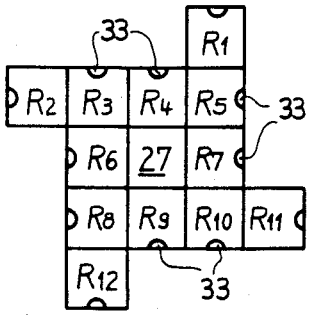

The blending pipe (18) extends through almost the complete length of the blending device inside the upper blending device (12), as depicted for example in cross-section in FIGS. 2 to 4. The blending pipe (18) almost protrudes to the lower end of the upper discharge funnel (15) whereby the cross-section (19) of the blending pipe (18) is approximately equal to the lower opening cross-section of the discharge funnel (15). In this way the lower end of the blending pipe (18) can taper conically (21) , widen (21') or be formed cylindrically (22).

The part of the upper discharge funnel (15) which protrudes into the cylindrical blending hopper (16) has apertures or outlet openings (23) in the body surface. An annular channel (24) forms between the discharge funnel (15) and the blending pipe (18). The material flowing through this ring channel (24) is transported through the discharge openings (23).

The inclination angle $\alpha$ of the upper discharge funnel (15) and the lower discharge funnel (17) has to be determined with the aid of known physical laws due to the friction values of the material particles, both on the hopper wall and on each other, to be determined in the laboratory, so that when the device (11) is emptied, the flow form of the mass flow described in the introduction sets in, during which the total contained bulk material (25) is involved in the flow process. In this way both the upper blending device (12) with the blending hopper (14) and the discharge funnel (15) as well as the lower blending device (13) with the blending hopper (16) and the discharge funnel (17) each form a mass flow silo, in which material extraction is possible throughout the whole individual hopper cross-section and through the complete height of the blending pipe (18). In this way material is extracted from the lower outlet (26) of the device (11) as well as bulk material from the inside of the blending pipe with mass flow (18) and also from the surrounding ring space (24). The same amount of material which leaves the blending pipe (18) at the lower end also flows throughout the complete height of the blending pipe distributed through the individual openings.

Normally the lower end of the blending pipe (18) is constructed cylindrically (22) (FIG. 1). Due to the alternative construction form of a funnel shaped tapering part (21) (see FIG. 5) on the lower end of the blending pipe (18') a throttle section is produced in the blending pipe, which results in a reduction of the drain velocity through the blending pipe (18'). This means that the velocity of the material in the outer surrounding ring area (24) around the lower end of the blending pipe is increased. Conversely the lower end of the blending pipe (18'') may also be widened outwards (21') in a funnel shape (see FIG. 5). As the same drain velocities always set in at the outlet of the blending pipe (18'') and at the outlet of the discharge funnel (15), independant of the diameter of the blending pipe and the filling level, the drain velocity within the blending pipe (18'') may be increased with the funnel shaped widening (21'), because due to the cross-section reduction of the ring space (24) surrounding the blending pipe (18'') a throttle section is formed for this ring space (24). In this way a large material mass flow may be drained through a narrow blending pipe. These variations are shown in FIG. 5. for clarity.

In the lower region (26) of the device (11) (FIG. 1) the material to be blended may be transported pneumatically back to the material surface (28) from the hopper outlet with the aid of a centrally installed conveying pipe (27) in order to reblend it, whereby the gas required for transport is supplied from a fan (29). The returned material rebounds at the upper end of the conveying pipe against a rebound or deflection plate (41).

Figure 5:
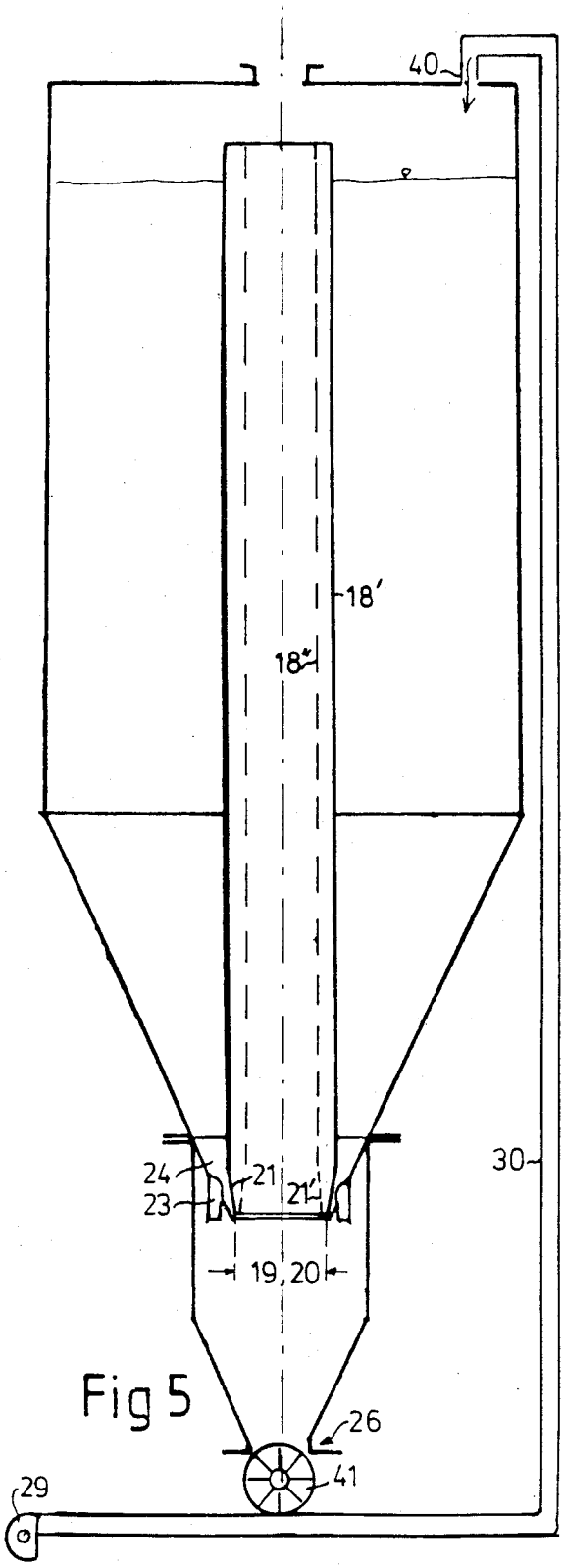
FIG. 5 A constructional variation of FIG. 1 with one outside pneumatic conveying line.

The alternative construction example shown in FIG. 5 shows a pneumatic conveying line (30) which is lead along outside the blending hopper. A rotary feeder (41) conveys the material into the line (30). Gas from the blower (29) conveys the material to the upper filling opening (40).

The inner construction of the blending pipe (18, 18' 18'', hereafter named "18") is shown alternatively in FIGS. 2 to 4. This pipe bundle (31) consists of a number of individual pipes ($R_1$ to $R_N$), which are concentrically or symetrically arranged around the middle axle (32). The pipes ($R_1$ to $R_N$) of the pipe bundle (31) are provided with inlet openings (1, 2, 4, 8) or comprehensive reference markings (33) according to the diagram in Figs. 2 to 4 or 6.

The submitted invention is based on the consideration that the same amount of material is extracted simultaneously at approximately equal intervals from each height in the blending device at each filling level in the blending device (12) through the pipe handle (18) so that constant discharge from all layers of the blending device is achieved.

For example if the pipe bundle (18) consists of 10 pipes ($R_1$ to $R_{10}$), it is desirable that with each filling level in the blending device (12) the same amount of material is extracted from approximately 10 equal part heights through the pipe bundle (18).To achieve this the individual pipes ($R_1$ to $R_{10}$) must have several inlet openings arranged above one another (1 to 8 or 33), whereby only the upper situated inlet opening below the filling level in each gravity pipe is effective, while the lower openings do not accept any material. To achieve this the mass flow through each effective inlet opening must be either the same size or larger than the mass flow through the lower outlet opening of the respective gravity pipe, so that the material drain only takes place through the uppermost inlet opening of each pipe. This is also in accordance with DE-ASNo.1 507 885.

Figure 6:
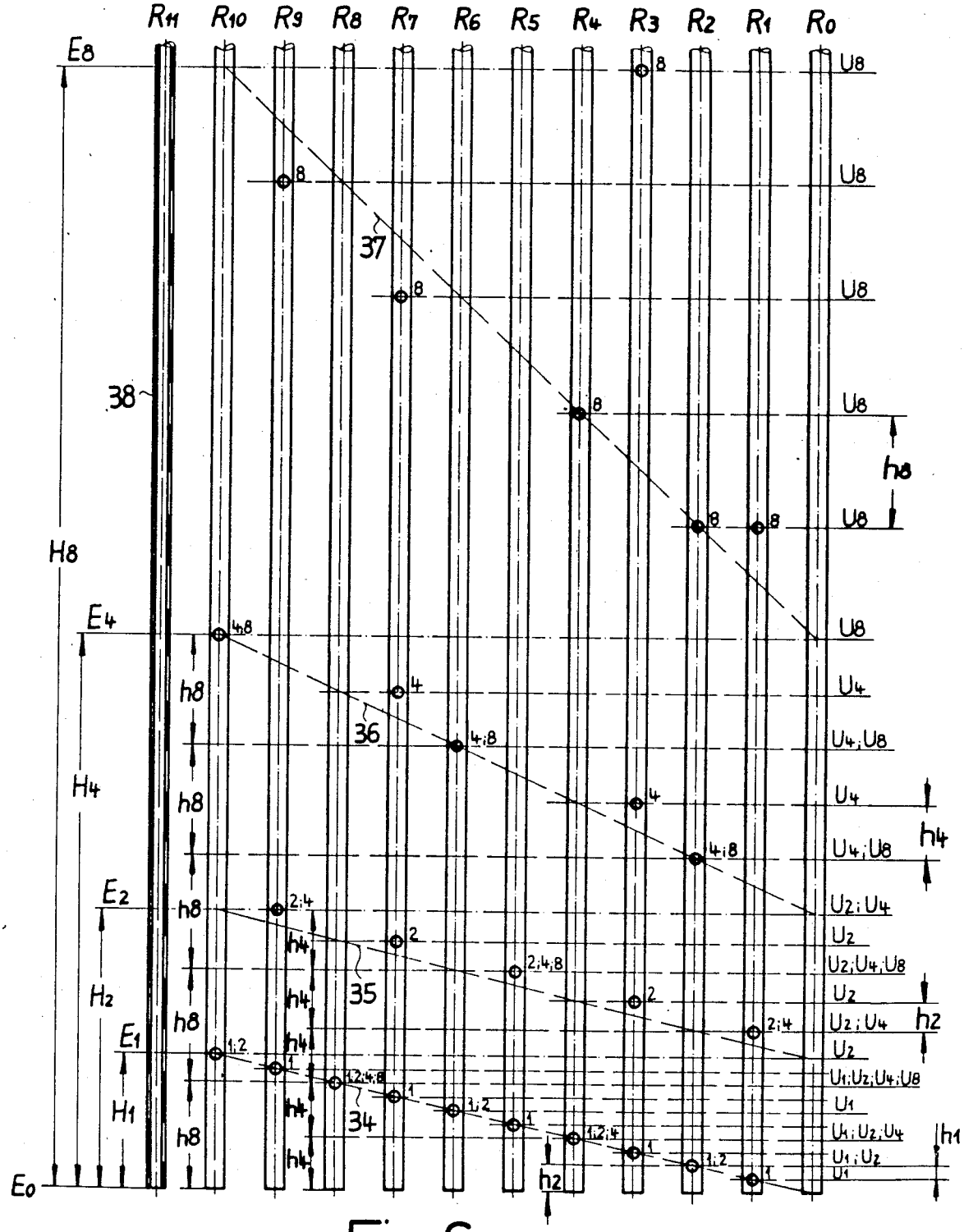
FIG. 6 The graphic determination of the inlet openings in the gravity pipes.

The depiction of the submitted invention in FIG. 6 shows the exact graphic determination of the inlet openings, with regard to the number and the position for each pipe.

In the example shown in FIG. 6 the blending pipe (18) consists of 10 pipes which are combined according to FIG. 3 or 4 to a pipe bundle (18, 31). In FIG. 2 only eight pipes were involved ($R_1$ to $R_8$). The pipe ($R_O$) shown in FIG. 6 shows the lower flow from the discharge funnel (15), as material is also taken at the lower end of the pipe bundle (18) from the surrounding ring gap (24). The same amount of material is taken from the ring gap (24) or from the outlet openings (23) below this cross-section as from one of the pipes ($R_1$ to $R_{10}$). The pipe ($R_O$) shown in FIG. 2 ($R_O$) is therefore the sum of the outlet openings (23).

In order to determine the height or the position of the inlet openings (1, 2, 4, 8), the pipes ($R_O$ to $R_{10}$) are stood side by side at equal intervals as the FIG. 6. The total height of the gravity pipes ($R_1$ to $R_{10}$) is then divided into main sections ($H_1$, $H_2$, $H_4$ and $H_8$) or main levels ($E_1$, $E_2$, $E_4$ and $E_8$). This is achieved by halving the respective remaining height downwards, i.e. the main level ($E_4$) results from halving the main level ($E_8$), the main level ($E_2$) by halving the main level ($E_4$) and the main level ($E_1$) by halving the main level ($E_2$). A series then results (1, 2, 4, 8, 16 etc.), by doubling the previous value. The determination of the main sections (H) or the main levels (E) is carried out by dividing the total height of the gravity pipes by halving the respective remaining height.

The next step is to divide each main section ($H_1$, $H_2$, $H_4$, $H_8$) individually into as many equal height intervals ($h_1$, $h_2$, $h_4$, $h_8$) as the number of pipes provided ($R_1$ to $R_{10}$), i.e. in the construction example into 10 equal height intervals (h). As shown in FIG. 6, the main section ($H_1$) is then divided into ten equal height intervals ($h_1$). The resulting levels are then designated as sub-levels ($U_1$).

The main section ($H_2$) is also divided into ten equal height intervals ($h_2$) whereby $h_2 = 2 \times h_1$. The resulting sub-levels are designated as ($U_2$). Each second sub-level ($U_1$) is therefore also a sub-level ($U_2$).

The main level ($H_4$) is also divided into ten height levels ($h_4$), which results in the sub-levels ($U_4$). The following formula applies;

$$h_4 = 2 \times h_2 = 4 \times h_1.$$

The fourth and eighth sub-levels ($U_1$) is therefore also a sub-level ($U_4$).

Finally in the construction example the main section ($H_8$) is also divided into ten equal height sections ($h_8$), resulting in the sub-levels ($U_8$). The following rule applies;

$$h_8 = 2 \times h_4 = 4 \times h_2 = 8 \times h_1$$

Therefore the eighth sub-level ($U_1$is equal to the first sub-level ($U_8$) etc.

Then the inlet openings (1,2,4,8) are determined, beginning from the bottom, for all gravity pipes ($R_1$ to $R_{10}$). This is carried out in the main section area ($H_1$) as follows: each pipe, beginning from the right, receives an inlet opening "1" after the interval ($h_1$). The intersection points of the ten sub-levels ($U_1$) with the pipes ($R_1$ to $R_{10}$) form the inlet openings "1" of the lower main section. If the material level is then on the level of the main level ($E_1$), material is then taken from each inlet opening "1" of each pipe ($R_1$ to $R_{10}$) at the same height intervals ($h_1$).

The main section ($H_2$) is divided into ten equal height intervals ($h_2$). In order to extract material from the sub-levels ($U_2$) at the height interval ($h_2$) when the material level is at main level ($E_2$), there must be a gravity pipe with an inlet opening "2" in each sub-level ($U_2$). Therefore in the main section ($H_1$) each second inlet opening is used at the height interval ($h_2$). The inlet openings shown in FIG. 6 "1, 2", are therefore effective when the filling level is at the main levels ($E_1$) and ($E_2$).

The inlet openings "2" result from the intersection points of the sub-levels ($U_2$) with the pipes ($R_1$ to $R_{10}$), whereby each pipe may only have one inlet opening "2". As is shown in FIG. 6 , the streams (34 to 37) may be used as a construction aid, which connect the lower level ($E_O$) with the level ($E_1$) (stream 34), the level ($E_1$) with the level ($E_2$) (stream 35), The level ($E_2$) with the level ($E_4$) (stream 36), the level ($E_4$) with the level ($E_8$) (stream 37). The intersection point of the streams with the gravity pipes ($R_1$ to $R_{10}$) then form the starting point for determination of each inlet opening. If for example in pipe ($R_2$) the lower inlet opening "2" already in use, the inlet opening is transferred to the next pipe, e.g. ($R_1$). A series of inlet openings "2" on the stream (35) therefore transfer to a neighbouring gravity pipe which does not yet have an inlet opening "2".

Each pipe ($R_1$ to $R_{10}$) therefore has an inlet opening "2" after the interval ($h_2$).

The inlet openings "4" are achieved in the same way, by forming—beginning from the bottom in FIG. 6—respective inlet openings at the height intervals ($h_4$), whereby existing inlets openings are used. The pipe ($R_4$) and the pipe ($R_8$) therefore already have an opening which may be used as inlet opening "4". This also applies for the pipes ($R_1$, $R_5$) and ($R_9$), by which the openings "2" which already exist may also be used as inlet openings "4". Important is each intersection point of the sub levels ($U_4$) with one of the pipes ($R_1$ to $R_{10}$).

As the pipe ($R_4$) in the lower region already has an inlet opening "4" at the intersection point with the stream (34), the pipe ($R_3$) is selected for the opening "4" at the intersection point with stream (36). This also applies for the pipe ($R_8$), where the inlet opening "4" is set in ($R_7$).

The inlet openings "8" are also carried out in the same way, which result from the intersection points of the lower levels ($U_8$) with the pipes ($R_1$ to $R_{10}$). Each pipe may only have one inlet opening "8". Beginning from the lower region of the graphic depiction in FIG. 6 the first available inlet opening in the pipe ($R_8$) is used in the lower sub-level ($U_8$) at the interval ($h_8$). This lowest inlet opening therefore serves as inlet opening "1, 2, 4, 8". The next inlet opening "8" is situated in pipe ($R_5$), formed as inlet opening "2, 4, 8". The next inlet opening "8" is situated in pipe ($R_2$), formed as inlet opening "4, 8". Following inlet openings are formed therfore in the pipes ( $R_6$, $R_{10}$, $R_1$, $R_4$, $R_7$ and $R_9$).

The uppermost inlet opening "8" in pipe ($R_{10}$) which lies on stream (37) is displaced, as there is already an inlet opening "8" in the pipe ($R_{10}$) to pipe ($R_3$), as this is the only pipe without an inlet opening "8".

If the pipe length of the pipes shown in FIG. 6 were redoubled, a main level ($E_{16}$) would be formed, with main sections ($H_{16}$) and equal height intervals ($h_{16}$). The inlet openings "16" would be situated at the intersection points of the sub-levels ($U_{16}$) with the respective pipes ($R_1$ to $R_{10}$), whereby existing inlet openings "16" in the lower region are used.

In FIG. 2 a first construction example with a cylindrical pipe cross-section is shown for the blending pipe (18). The ray form chamber division with dividing walls (39) provides eight chambers ($R_1$ to $R_8$), which form the pipe bundle (31). The determination of the inlet openings is carried out in an analogue manner as described previously. The circular cross-section may also of course be divided into either ten, eleven or twelve equal circular segments. By dividing 360 degrees by the number of pipes the segment angle $\beta$ is obtained.

In FIG. 3 a construction example is shown, how the pipes described in FIG. 6 ($R_1$ to $R_{10}$) could be formed. If an hexagonal cross-section is selected, twelve pipes could be combined in a honeycomb manner, which means a high stability of the pipe bundle (31). The indicated inlet openings (33) in FIG. 3, according to the inlet openings (1, 2, 4, 8, etc.) in FIG. 6 are always directed outwards so that the material can flow inwards. The centre channel "27" shown in FIG. 6 shows a return line for the material circulation.

The construction example according to FIG. 4 shows an alternative to FIG. 3. In this case a quadratic cross-section is used instead of an hexagonal cross-section. The remaining construction is carried out in the form of a larger square with nine single squares, to which four further squares ($R_1$, $R_2$, $R_{11}$, $R_{12}$) are attached.

If twelve pipes are used, as shown in FIGS. 3 and 4, the distribution of the inlet openings is carried out according to the diagram in FIG. 6. The main sections ($H_1$, $H_2$, $H_4$, $H_8$) are then divided into twelve equal height intervals ($h_1$, $h_2$, $h_4$, $h_8$).

In FIG. 6 the pipe ($R_{11}$) designated as "$R_{N+1}$" is shown. This pipe ($R_{11}$) has staggered overlapping inlet openings (38), which extend thoughout the whole length of the pipe. In this way material is always taken from the respective surface.

I claim:

1. Device for blending dust, powder or coarse particle bulk materials, comprising a first upper blending device with a cylindrical blending container and a connecting upper discharge funnel tapering conically towards a second lower blending device with a cylindrical container and a connecting discharge hopper which tapers conically towards the bottom to form an upper and lower mass flow silo, a blending pipe concentrically installed in the upper blending device for mass flow, which extends approximately to the lower end of the upper connecting discharge funnel, whereby the blending pipe contains inlet openings throughout its whole length for bulk material; and wherein: the concentrically installed blending pipe is vertically subdivided into numerous gravity pipes arranged side by side, each of which contains several inlet openings arranged above one another, said blending pipe is constructed cylindrically in the lower end region; and means are provided for transporting the bulk material situated at the lower end of the lower blender device back to the upper material surface of the device via a conveying pipe.

2. Device according to claim 1, wherein the discharge funnel of the first upper blending device protrudes into the cylindrical blending hopper of the second lower blending device up to the cross-section opening of the blending pipe, whereby the discharge funnel contains apertures or concentrically arranged outlet openings in this region to enable unimpeded material flow from the discharge funnel.

3. Device according to claim 2, wherein the apertures or outlet openings in the lower region of the upper discharge funnel receive the total material flow from this discharge funnel and that the flow cross-section of all the apertures or outlet openings is the same as the cross-section of one of the gravity pipes.

4. Device according to claim 1, wherein the gravity pipes in the blending pipe are formed by diagonally arranged dividing walls for formation of a gravity pipe bundle.

5. A device according to claim 1 wherein the position of the inlet openings in each gravity pipe has been determined by the following steps: arranging the total number of gravity pipes at regular intervals side by side; dividing the total height of the gravity pipes into main sections or main levels by halving the total height and then halving each remaining height in a downward direction; dividing each main section into the same number of height sections as the total number of gravity pipes; and designating, by beginning to the lower region of the side by side arrangement of gravity pipes, one inlet opening per gravity pipe in each height interval of each main section, with existing inlet openings in the lower main sections at the respective height intervals being utilized for the designated openings in the main sections situated above.

6. The device according to claim 5, wherein the height intervals form sub-levels, whereby a pipe is provided in each sub-level with an inlet opening.

7. The device according to claim 6, wherein a further gravity pipe is provided next to the gravity pipes, which further pipe contains staggered overlapping inlet openings throughout its whole length for permanent material drain from each product surface.

8. The device according to claim 5, wherein a further gravity pipe is provided next to the gravity pipes, which further gravity pipe contains staggered overlapping inlet openings throughout its entire length for permanent material drain from each produce surface.

9. Device according to claim 1, wherein the blending pipe also contains another conveying pipe in addition to the gravity pipes for downward material transport , which serves to convey the bulk material from the lower hopper discharge back to the surface of the bulk material load, whereby a pneumatic conveying device is provided.

10. Device according to claim 1, wherein said means for transporting is a pneumatical device.

11. Device according to claim 1, wherein said conveying pipe is mounted inside said blending pipe.

12. Device according to claim 1, wherein said conveying pipe is mounted outside said blending pipe.

13. Device according to claim 1, wherein the gravity pipes in the blending pipe are formed by pipes arranged side by side with either honeycomb shaped hexagonal or quadratic cross-section, for formation of a gravity pipe bundle.

14. Device according to claim 1, wherein the lower end region of said blending pipe tapers to a funnel in this region.

15. Device according to claim 1, wherein the lower end region of said blending pipe widens in this region.

* * * * *